US007946042B2

(12) United States Patent
Williams

(10) Patent No.: US 7,946,042 B2
(45) Date of Patent: May 24, 2011

(54) APPARATUS AND A METHOD FOR DRAFTING A FRAMEWORK FOR A PATTERN

(76) Inventor: Debra Williams, Sterling, NY (US)

( * ) Notice: Subject to any disclaimer, the term of this patent is extended or adjusted under 35 U.S.C. 154(b) by 18 days.

(21) Appl. No.: 12/497,624

(22) Filed: Jul. 3, 2009

(65) Prior Publication Data

US 2010/0083514 A1 Apr. 8, 2010

Related U.S. Application Data

(60) Provisional application No. 61/085,393, filed on Jul. 31, 2008.

(30) Foreign Application Priority Data

Aug. 1, 2007 (NZ) ..... 560237

(51) Int. Cl.
*B43L 9/04* (2006.01)

(52) U.S. Cl. ..... 33/27.03; 33/27.032

(58) Field of Classification Search ..... 33/27.01, 33/27.02, 27.03, 27.031, 27.032, 27.933, 33/27.04, 27.06, 27.07, 27.033
See application file for complete search history.

(56) References Cited

U.S. PATENT DOCUMENTS 2,054,420 A * 9/1936 Hochman ..... 33/27.01
2,797,493 A 7/1957 Watson
3,766,654 A 10/1973 Canton
4,103,426 A * 8/1978 Robin ..... 33/27.03
4,685,496 A * 8/1987 Livick ..... 33/27.04
5,615,485 A * 4/1997 Stoneberg ..... 33/27.03
5,735,052 A * 4/1998 Lin ..... 33/27.03
6,276,070 B1 8/2001 Hawley
6,345,985 B1 2/2002 Arend et al.
6,357,370 B1 3/2002 Fritz et al.
6,467,179 B1 10/2002 Wolf
6,944,963 B2 9/2005 Amaru
7,043,850 B2 5/2006 Brady
7,191,530 B1 * 3/2007 Thibodeaux ..... 33/27.032
7,194,970 B2 3/2007 Srebro
7,469,483 B2 12/2008 Martin et al.
2003/0019116 A1 * 1/2003 DeWall ..... 33/27.032
2003/0182811 A1 * 10/2003 Hairapetian ..... 33/27.032
2004/0172844 A1 9/2004 Murray et al.
2005/0155234 A1 * 7/2005 Xieh ..... 33/27.03
2006/0032068 A1 2/2006 Sherman et al.
2009/0025245 A1 1/2009 Brady
2010/0115777 A1 * 5/2010 Lee ..... 33/27.01

* cited by examiner

*Primary Examiner* — G. Bradley Bennett
(74) *Attorney, Agent, or Firm* — Ariel S. Bentolila; Bay Area IP Group, LLC

(57) ABSTRACT

An apparatus for drafting a framework for a pattern and a method of using the apparatus is presented. The apparatus includes a generally rigid planer structure. A pivot point includes a pivot point aperture extending through the rigid planer structure for enabling scribing a center point of the framework and rotating the rigid planer structure about the center point. A plurality of lines pass through the pivot point. Each of the plurality of lines includes a plurality of apertures for enabling scribing marks for forming a basis for lines in the framework. At least one line of generally equally spaced longitudinal apertures, wherein each of the longitudinal apertures is at a first fixed radial distance from the pivot point, enables scribing a circle for the framework, where the circle is scribed by rotation of the rigid planer structure about the pivot point.

20 Claims, 7 Drawing Sheets

APPARATUS AND A METHOD FOR DRAFTING A FRAMEWORK FOR A PATTERN

CROSS-REFERENCE TO RELATED APPLICATIONS

The present Utility patent application claims priority benefit of the U.S. provisional application for patent Ser. No. 61/085,393 31 Jul. 2008 Mariner's Compass Star Drafting Tool under 35 U.S.C. 119(e). The present Utility patent application also claims priority benefit of the New Zealand patent application number 560237 filed on Aug. 1, 2007 under 35 U.S.C. 119(a). The contents of this related provisional application and foreign patent application are incorporated herein by reference for all purposes.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The present invention relates generally to drawing instruments. More particularly, the invention relates to a geometrical drafting instrument capable of drawing circles and straight lines at exact intervals and precise angles.

BACKGROUND OF THE INVENTION

The present invention was originally developed to solve a longstanding problem among quilters, specifically the drafting of the framework for a Mariner's Compass star pattern. The drafting of a Mariner's Compass pattern using currently known methods is a laborious, time-consuming project. The results are often difficult to replicate unless the person drafting the pattern is highly skilled at technical drawing. Among quilters this desirable pattern is generally considered to be difficult to draft as there are many steps and several tools involved in creating the final pattern. The process requires absolute precision and a very high level of skill using a compass.

Typical problems encountered while using a compass, such as slippage, are compounded by the other steps necessary to successfully draw the framework. The person drafting this pattern must draft two perfect circles of different diameters, one exactly centered within the other. They then must draw lines converging at specific angles in the center of these circles. This can make the pattern frustrating to draft even for the most careful artist.

The traditional method for drafting the simplest version of a Mariner's Compass star, with rays formed in multiples of four, is to draft an absolutely perfect square and then find the perfect center by intersecting diagonal, horizontal and vertical lines. The star is then drafted by placing a compass point precisely at the intersection of these lines and drawing two or more perfect, concentric circles. Subsequent lines may then be drawn from this foundational framework to create stars of varying sizes and with varying numbers of points. Even the slightest error at any stage of drafting the framework creates an inferior and often unusable pattern. It is not uncommon for quilters drafting this framework to make many attempts at this time-consuming process before producing a usable pattern. It is therefore an objective of the present invention to provide an improved method for easily drawing the framework for a Mariner's Compass star pattern.

Few practical options exist for quilters to produce star patterns by any other means. Paper patterns and rigid plastic templates exist; however, these limit the drafter to tracing the predetermined size and scope of the preprinted stars or templates. The template sets are for specific sized Mariner's Compass star patterns and require many pieces of different sizes and shapes to create even one star. Therefore, these patterns and templates do not solve the problem of freely drafting stars of any size and shape.

In view of the foregoing, there is a need for improved techniques for providing a tool that simplifies the process of drafting the Mariner's Compass star framework pattern, guarantees precision, and offers flexibility in sizing and patterning options.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1 is a diagrammatic frontal view of the tool with guide marks. FIG. 2 is a diagrammatic side view of the tool, and FIG. 3 is a diagrammatic frontal view of the tool without guide marks;

FIG. 4 is a diagrammatic view of an exemplary configuration of geometric marks that are created by the drawing tool, and FIG. 5 is a diagrammatic view of an exemplary framework of lines that may be created by the drawing tool;

FIG. 8 is a frontal diagrammatic view of a drawing tool with apertures arranged to provide a framework for Mariner's Compass stars with rays in multiples of three, and FIG. 9 is a frontal view of a drawing tool with apertures arranged to provide a framework for Mariner's Compass stars with rays in multiples of five;

FIG. 11 is a side perspective view of the tool being used to draft an inner circle of the framework, and FIG. 12 is a side perspective view of the tool being used to draft a larger, outer circle of the framework.

Figures 1, 2, 3:
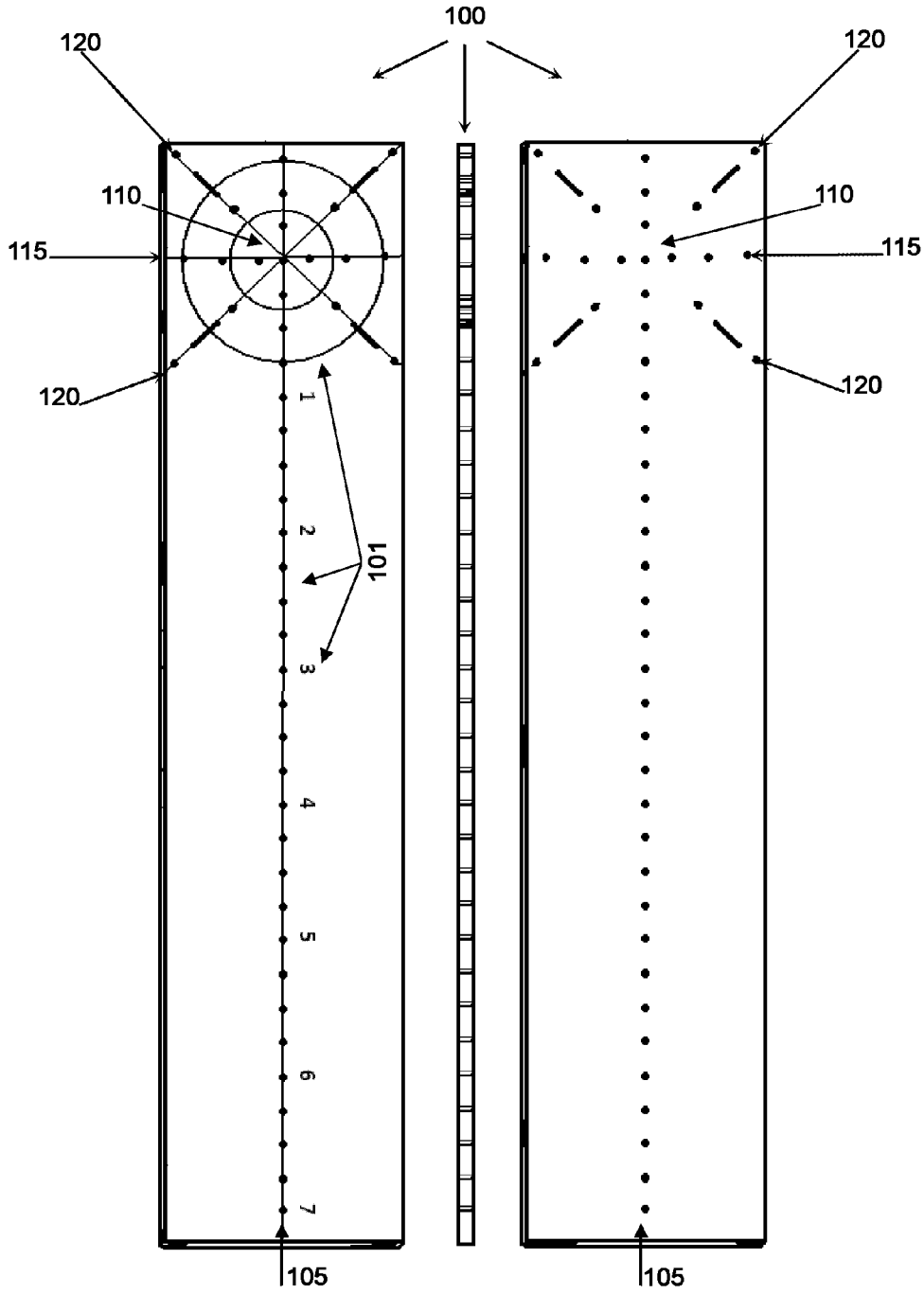
FIGS. 1, 2 and 3 illustrate an exemplary drawing tool for creating the framework for a Mariner's Compass star, in accordance with an embodiment of the present invention.

Unless otherwise indicated illustrations in the figures are not necessarily drawn to scale.

SUMMARY OF THE INVENTION

To achieve the forgoing and other objects and in accordance with the purpose of the invention, an apparatus and a method for drafting a framework for a pattern is presented.

In one embodiment an apparatus for drafting a framework for a pattern is presented. The apparatus includes a generally rigid planer structure, means for enabling scribing a center point of the framework and rotating the rigid planer structure about the center point, means for enabling scribing marks for forming a basis for lines in the framework and means for enabling scribing a circle for the framework where the circle is scribed by rotation of the rigid planer structure about the center point. Another embodiment further includes means for pivotally securing the apparatus for rotating about the center point. Yet another embodiment further includes means for enabling determination of dimensions of scribed lines for the framework. Still another embodiment further includes means for adjustably lengthening the means for enabling scribing a circle. Yet another embodiment further includes means for joining the means for adjustably lengthening to the apparatus. Still another embodiment further includes additional means for enabling scribing a circle for the framework.

In another embodiment an apparatus for drafting a framework for a pattern is presented. The apparatus includes a generally rigid planer structure. A pivot point includes a pivot point aperture extending through the rigid planer structure for enabling scribing a center point of the framework and rotating the rigid planer structure about the center point. A plurality of lines pass through the pivot point. Each of the plurality of lines includes a plurality of apertures for enabling scribing marks for forming a basis for lines in the framework. At least one line of generally equally spaced longitudinal apertures, wherein each of the longitudinal apertures is at a first fixed radial distance from the pivot point, enables scribing a circle for the framework, where the circle is scribed by rotation of the rigid planer structure about the pivot point. Another embodiment further includes means for pivotally securing the apparatus for rotating about the pivot point. Yet another embodiment further includes indicia for enabling determination of dimensions of scribed lines for the framework. Still another embodiment further includes a length adjustable apparatus for adjustably lengthening the line of longitudinal apertures. Yet another embodiment further includes a flexible connection for joining the length adjustable apparatus to the apparatus. Still another embodiment further includes an additional line of generally equally spaced additional longitudinal apertures, wherein each of the additional longitudinal apertures is at a second fixed radial distance from the pivot point, for enabling scribing a circle for the framework, where the circle is scribed by rotation of the rigid planer structure about the pivot point. In yet another embodiment the rigid structure includes an acrylic, polymer or metal material. In still another embodiment the rigid structure is sufficiently transparent for viewing scribed lines.

In another embodiment a method for drafting a framework for a pattern using the apparatus of claim 7 is presented. The method includes steps for placing the apparatus on a desired drafting surface, steps for scribing the center point and scribing marks for a basis for lines in the framework, steps for choosing longitudinal apertures, steps for scribing a plurality of circles for the framework, steps for removing the apparatus from the drafting surface, steps for scribing diametric lines, of an outermost circle of the plurality of circles and steps for using the framework to scribe the pattern. Yet another embodiment further includes steps for of securing the apparatus to the drafting surface. Still another embodiment further includes steps for adjustably lengthening the line of longitudinal apertures.

In another embodiment a method for drafting a framework for a pattern using the apparatus of claim 7 is presented. The method includes the steps of placing the apparatus on a desired drafting surface for the apparatus to freely rotate about the pivot point. Scribing the drafting surface through the pivot point and apertures of the plurality of lines for forming the center point and scribing marks for a basis for lines in the framework. Choosing longitudinal apertures. Scribing a plurality of circles for the framework by using the chosen longitudinal apertures and rotating the apparatus relative to the drafting surface about the pivot point. Removing the apparatus from the drafting surface. Scribing diametric lines, of an outermost circle of the plurality of circles, along the scribing marks, for lines in the framework. Using the framework to scribe the pattern. Yet another embodiment further includes the step of securing the apparatus to the drafting surface for rotating about the pivot point. Still another embodiment further includes the step of joining a length adjustable apparatus to the apparatus for adjustably lengthening the line of longitudinal apertures.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention will now be described in detail with reference to embodiments thereof as illustrated in the accompanying drawings.

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Preferred embodiments of the present invention provide instruments that enable a person to quickly and accurately draw the geometric shapes and lines that are necessary to form a Mariner's Compass star framework in a reliable and repeatable way. Preferred embodiments enable users to create patterns that are personalized as to size, shape and number of components. Preferred embodiments also enable users to create the patterns with the use of only one tool. Furthermore, preferred embodiments enable users to create predetermined angles for the straight lines of the framework, which generally removes the "human error" component that frequently ruins these patterns.

FIGS. 1, 2 and 3 illustrate an exemplary drawing tool 100 for creating the framework for a Mariner's Compass star, in accordance with an embodiment of the present invention. FIG. 1 is a diagrammatic frontal view of tool 100 with guide marks 101. FIG. 2 is a diagrammatic side view of tool 100, and FIG. 3 is a diagrammatic frontal view of tool 100 without guide marks 101. In the present embodiment, tool 100 may be made using various different means including, but not limited to, mechanical drilling, laser cutting, die-casting, or punch cutting. Tool 100 may be made of a transparent or semi-transparent substance such as, but not limited to, plastic, acrylic, etc. to enable a user to see the lines being formed on the paper beneath tool 100. However, tools in alternate embodiments may be made of other rigid materials such as, but not limited to, metal, wood, cardboard, etc. In the present embodiment, tool 100 has a rectangular shape; however, tools in alternate embodiments may be created in other planar geometric shapes such as, but not limited to, squares, triangles, or circles.

In the present embodiment, a longitudinal line of apertures 105 extends from a pivot point 110 to the top and bottom edges of tool 100. A horizontal line of apertures 115 extends from pivot point 110 to the right and left sides of tool 100. A multiplicity of angular apertures 120 radiate from pivot point 110 to indicate the necessary lines for creating the framework for a Mariner's Compass star, as shown by way of example in FIG. 5. Pivot point 110, where all of the straight guidelines converge, is both the pivot point of tool 100 and the center of the resulting framework. Longitudinal apertures 105 replace the need for a compass in drawing concentric circles that form a Mariner's Compass star framework, as illustrated by way of example in FIGS. 11 and 12. The positioning of longitudinal apertures 105 generally ensures that the circles are precisely centered to the framework and can be used to draw a star of any size within the constraints of the tool size. It should be noted that in the present embodiment a center hole of the tool is used as the pivot point and is never actually drawn through. The way the lines come together makes an intersection at that actual center point. In the present embodiment, longitudinal apertures 105 are equidistant from each other; however, the longitudinal lines in alternate embodiments may vary in spacing. Angular apertures 120 include circular holes as well as elongated slots in present embodiment; however, the apertures in alternate embodiments may only be circular holes, for example, without limitation, the embodiments illustrated by way of example in FIGS. 6 through 9. In other alternate embodiments the apertures may only be slots, and in yet other alternate embodiments, various different configurations of circular holes, slots and apertures of different shapes may be included to guide users.

Referring to FIG. 1, tool 100 may comprise guide marks 101 and/or measuring lines or grids that enable the user to accurately determine the size of the shapes they are drawing. Guide marks 101 may be etched, drawn or otherwise printed in or on tool 100. However, referring to FIG. 3, embodiments may be implemented without guide marks. Guide marks in various embodiments of the present invention may include, without limitation, geometric shapes, alphanumeric symbols, straight or curved lines, etc. Color may also be used in some embodiments to enhance certain elements of the tool including, but not limited to, highlighting the pivot point, delineating measurements by marking every inch of the tool with numbers of different colors or by making the lines along the longitudinal line of symmetry different colors, etc.

Figure 4:
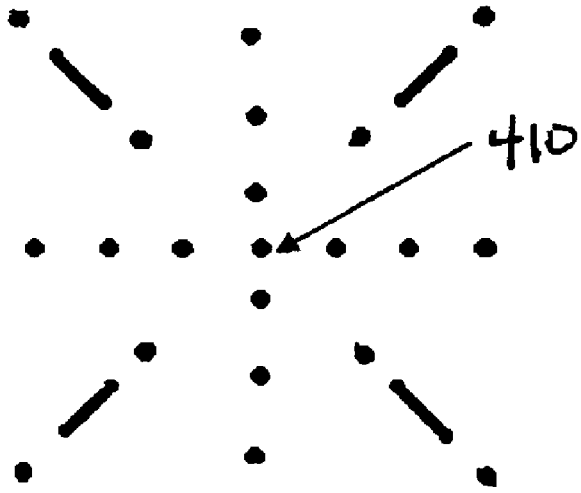
FIGS. 4 and 5 illustrate exemplary drawings that may be made by using a drawing tool for creating the framework for a Mariner's Compass star, shown by way of example in FIGS. 1 through 3, in accordance with an embodiment of the present invention.
Figure 5:
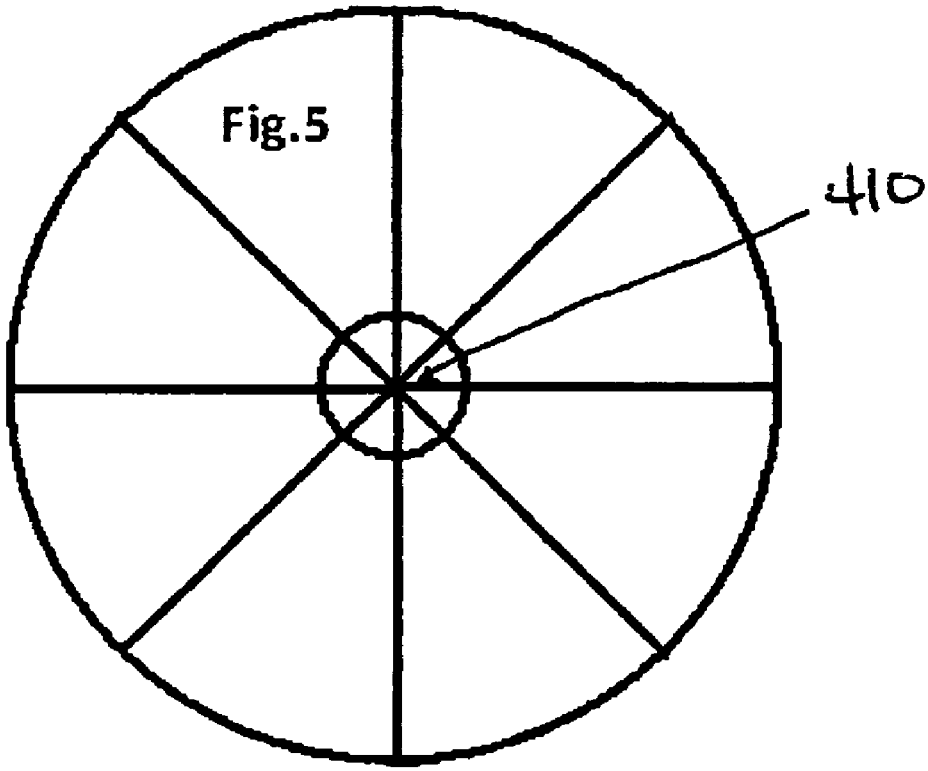

FIGS. 4 and 5 illustrate exemplary drawings that may be made by using drawing tool 100 for creating a Mariner's Compass star, shown by way of example in FIGS. 1 through 3, in accordance with an embodiment of the present invention. FIG. 4 is a diagrammatic view of an exemplary configuration of geometric marks that are created by drawing tool 100, and FIG. 5 is a diagrammatic view of an exemplary framework of lines that may be created by tool 100. Referring to FIG. 4, tool 100 comprises a number of apertures at precisely determined intervals and angles that enable a user to create marks needed to compose the framework of a Mariner's Compass star. These marks radiate from a center point 410, which corresponds to pivot point 110 of tool 100. Referring to FIG. 5, by connecting the marks made by tool 100, as shown by way of example in FIG. 4, and using tool 100 to make multiple circles, the framework for a Mariner's Compass star can be formed. Tool 100 enables the user to fix the exact center of the circles and lines that form the framework of a Mariner's Compass star pattern at center point 410. The geometrically arranged system of apertures in tool 100 generally ensures that the framework is accurate, repeatable and formed quickly and precisely. Those skilled in the art, in light of the present teachings, will readily recognize that the marks and frameworks that may be formed by embodiments of the present invention may also be used to create a multiplicity of designs other than Mariner's Compass stars such as, but not limited to, Grandmother's Fan, Starburst, Sunburst, Sunflower, Starshine, Turkey Tracks, Robbing Peter to Pay Paul, Double Wedding Ring, Citrus Sorbet, Orange Peel, Ferris Wheel, Wagon Wheel, Cog Wheel, Drunkard's Path, Queen's Crown, Tea Leaves, Palm Leaf, Bay Leaf, Melon Patch, Windmill, Snowball, New Moon, Fore and Aft, Moon and Stars, Steeplechase, Fool's Puzzle, Endless Trail, Old Maid's Puzzle, Boston Trail, Tumbleweed, Pumpkin Vine, Oregon's Trail, Dresden Plate, Snake Path, Circle Cross, Wheel of Life, Lover's Knot, Job's Tears, Pullman Puzzle, Snail's Trail, Hand's All Around, New York Beauty, Sunrise, Aster, Farmer's Delight, Wheel of Whimsy, Pilot's Wheel, Sawtooth Circle, Cactus Rose, Circular Flying Geese, Bows and Arrows, Imperial Fan, Indian Summer, Round Table, Lattice Fan, Diamond Fan, Daisy Wheel, Feather Star, Southern Star, Blazing Star, French Star, Dessert Plate, Kansas Sunflower, Calico Rose, Double Fans, King's Crown, Fox and Geese, Lady Fingers, Buggy Wheel, Duke's Dilemma, Indian Summer, Baby Bunting, County Fields, Baby Aster, Mountain View, Mountain Trail, Harvest Moon, Missouri Beauty].

Figure 6:
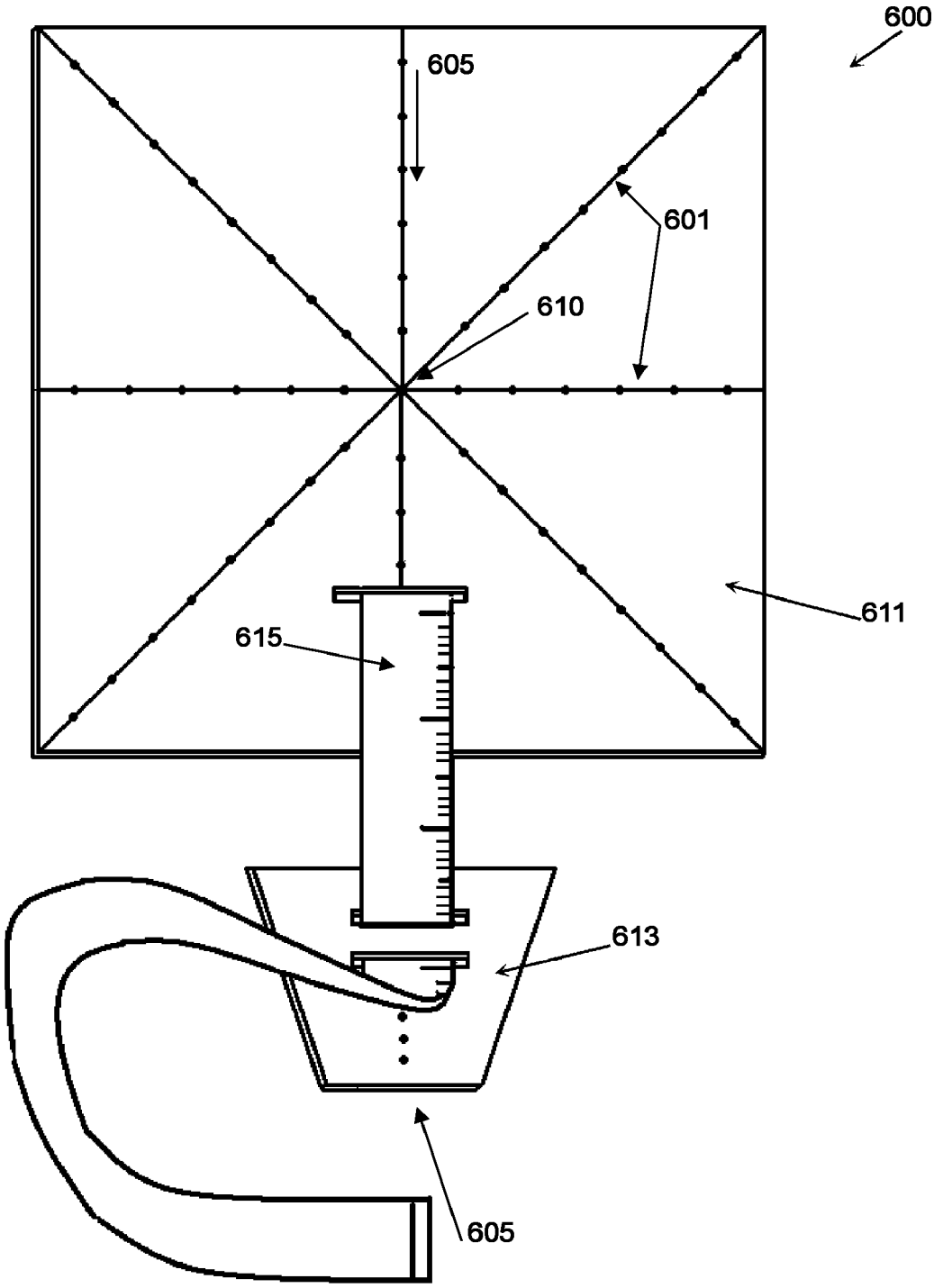
FIG. 6 is a frontal diagrammatic view of a square drawing tool for creating the framework for Mariner's Compass stars, in accordance with an embodiment of the present invention.

FIG. 6 is a frontal diagrammatic view of a square drawing tool 600 for creating the framework for Mariner's Compass stars, in accordance with an embodiment of the present invention. Tool 600 comprises a divided longitudinal line of apertures 605 extending from a pivot point 610 on a pivoting unit 611 onto a length adjustable apparatus 613. In the present embodiment, a flexible connection apparatus 615 such as, but not limited to, a measuring tape, chord, wire, string or a strap that can be adjusted to a desired length connects pivoting unit 611 to length adjustable apparatus 613. Alternately a rigid apparatus such as, but not limited to, a stick, a board, a pipe, a ruler, or a piece of plastic, acrylic or metal may connect pivoting unit 611 to length adjustable apparatus 613 to form a rigid unit. The use of a flexible or rigid connection apparatus effectively restores the continuance of longitudinal line of apertures 605. In the present embodiment, pivoting unit 611 comprises guide marks 601; however, alternate embodiments may be implemented without guide marks.

Figure 7:
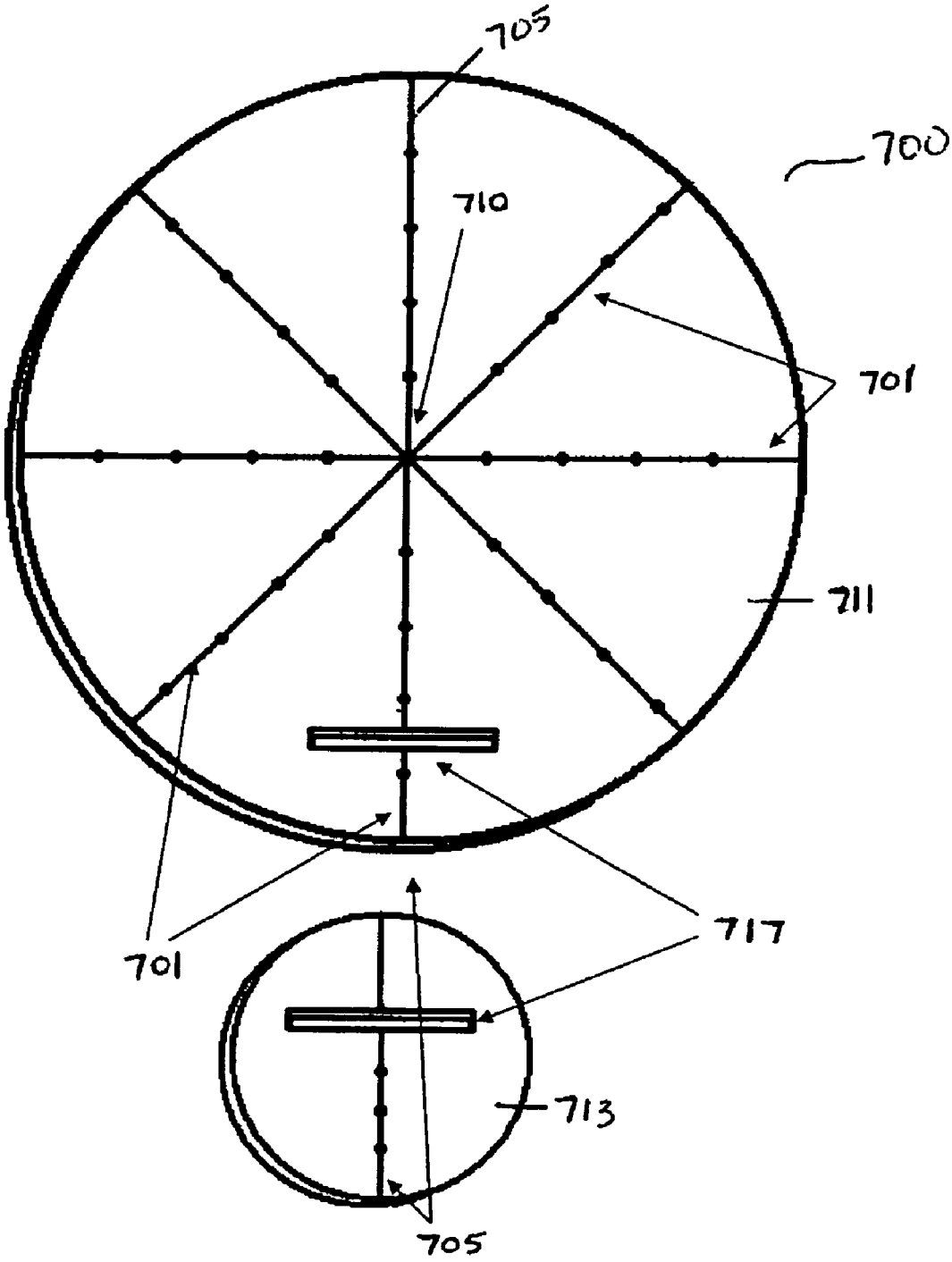
FIG. 7 is a frontal diagrammatic view of a circular drawing tool for creating the framework for Mariner's Compass stars, in accordance with an embodiment of the present invention.

FIG. 7 is a frontal diagrammatic view of a circular drawing tool 700 for creating the framework for Mariner's Compass stars, in accordance with an embodiment of the present invention. In the present embodiment, tool 700 has a physical division across a longitudinal line of apertures 705 extending from a pivot point 710 and comprises two units, a pivoting unit 711 and a length adjustable apparatus 713. Tool 700 comprises enlarged apertures 717 for affixing connection means for connecting pivoting unit 711 to length adjustable apparatus 713. A flexible or rigid apparatus may be used as the connection means to connect the two sections of tool 700. This connection means may be placed through enlarged apertures 717 and may or may not utilize means for enhanced attachment such as, but not limited to, suction, adhesion, embedment, or affixation. In the present embodiment, pivoting unit 711 and length adjustable apparatus 713 comprise guide marks 701; however, alternate embodiments may be implemented without guide marks.

Figure 8:
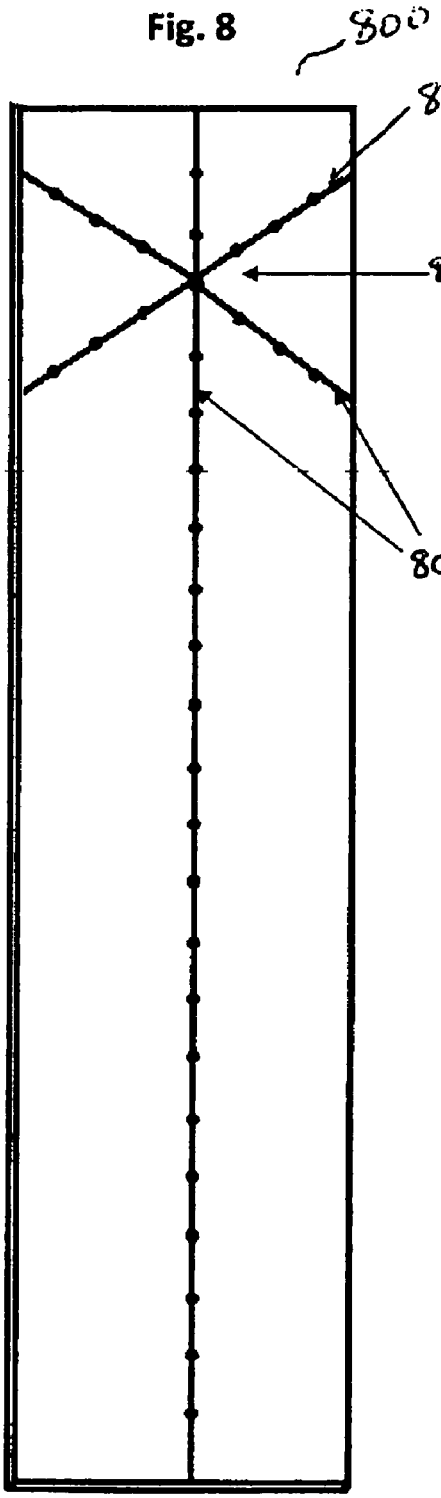
FIGS. 8 and 9 illustrate exemplary drawing tools with apertures arranged for drawing the frameworks for Mariner's Compass stars with varying numbers of rays, in accordance with embodiments of the present invention.
Figure 9:
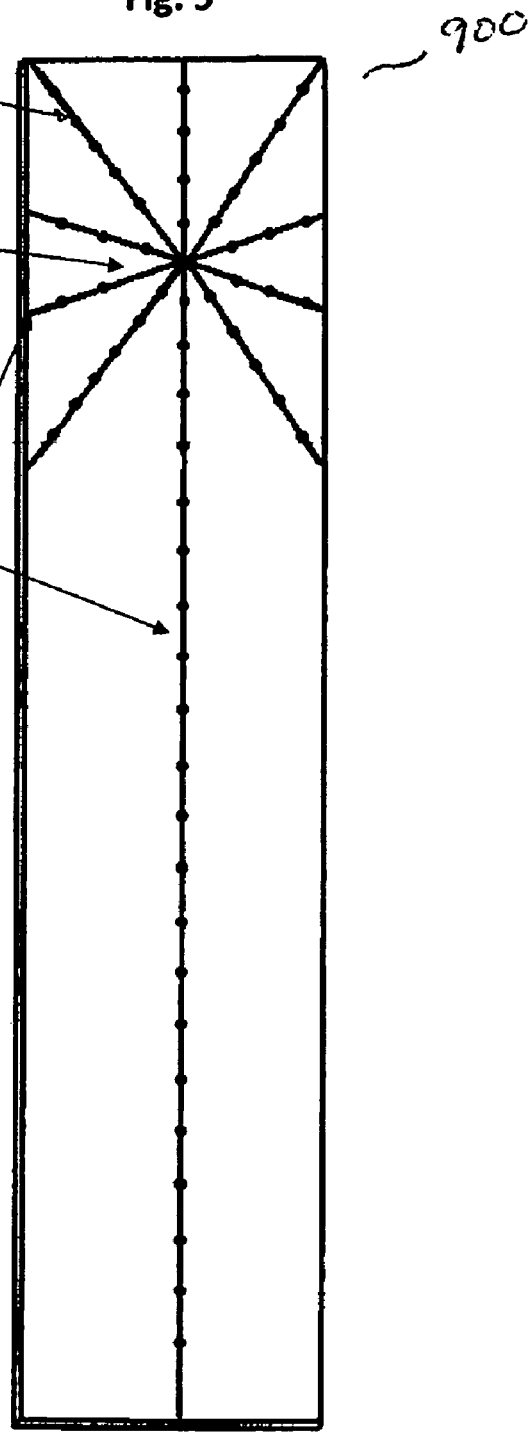

FIGS. 8 and 9 illustrate exemplary drawing tools 800 and 900 with apertures arranged for drawing the frameworks for Mariner's Compass stars with varying numbers of rays, in accordance with embodiments of the present invention. FIG. 8 is a frontal diagrammatic view of a drawing tool 800 with apertures arranged to provide a framework for Mariner's Compass stars with rays in multiples of three, and FIG. 9 is a frontal view of a drawing tool 900 with apertures arranged to provide a framework for Mariner's Compass stars with rays in multiples of five. In the present embodiments, the geometrically arranged systems of apertures comprise rows of apertures 805 radiating from a central pivot point 810 at equal angles from each other. The number of rows of apertures 805 pointing toward pivot point 810 determines the number of rays that may be created with a framework drafted using a particular tool, and those skilled in the art, in light of the present teachings, will readily recognize that various embodiments of the present invention may be implemented to create frameworks with more or fewer rays. In the present embodiments, tools 800 and 900 comprise guide marks 801; however, alternate embodiments may be implemented without guide marks.

Figure 10:
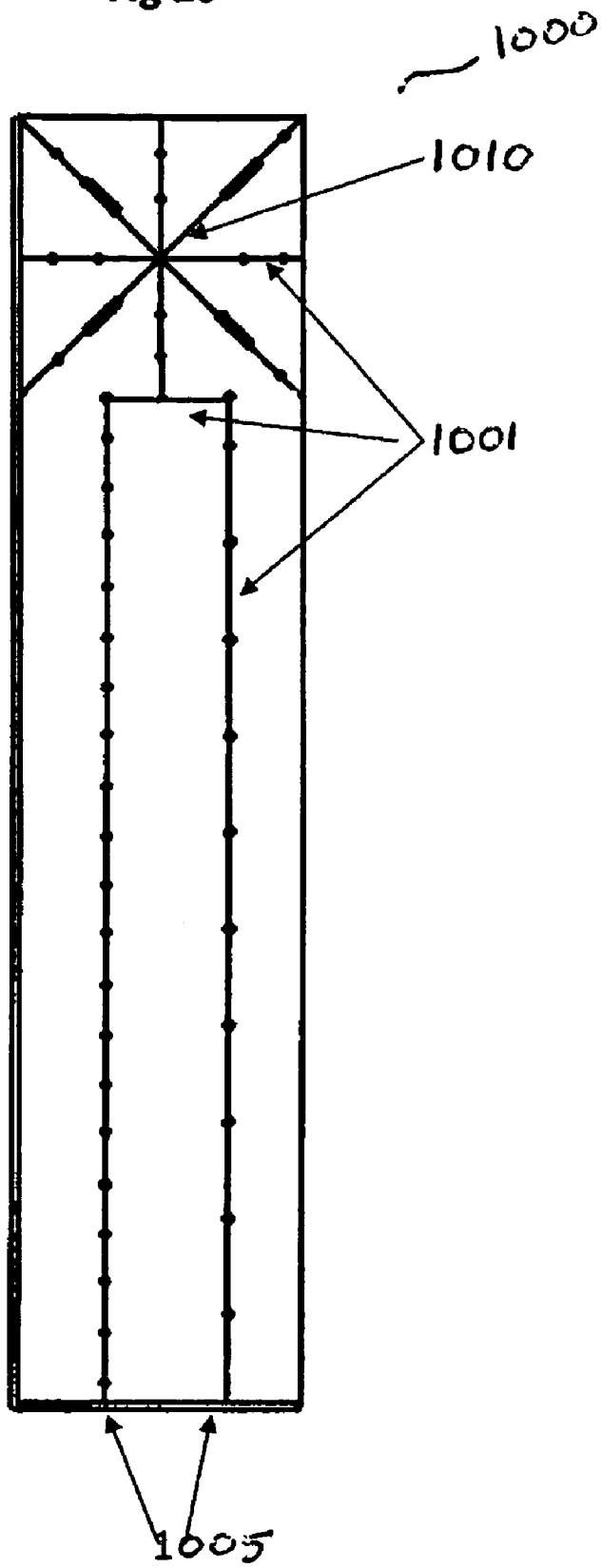
FIG. 10 is a frontal view of an exemplary drawing tool for creating the framework for Mariner's Compass stars with multiple longitudinal lines of apertures, in accordance with an embodiment of the present invention.

FIG. 10 is a frontal view of an exemplary drawing tool 1000 for creating the framework for Mariner's Compass stars with multiple longitudinal lines of apertures 1005, in accordance with an embodiment of the present invention. In the present embodiment, each longitudinal line of apertures 1005 comprises differently spaced apertures to increase the number of differently sized circles that may be made with tool 1000 around a pivot point 1010. Tool 1000 comprises guide marks 1001; however, alternate embodiments may be implemented without guide marks.

Figure 11:
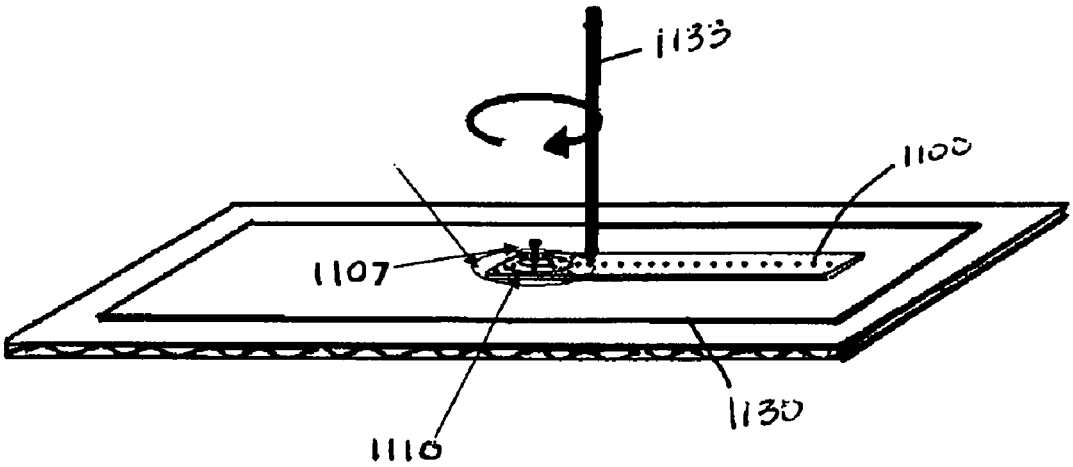
FIGS. 11 and 12 illustrate an exemplary method for using a drawing tool for drawing the circles of the framework for a Mariner's Compass star, in accordance with an embodiment of the present invention.
Figure 12:
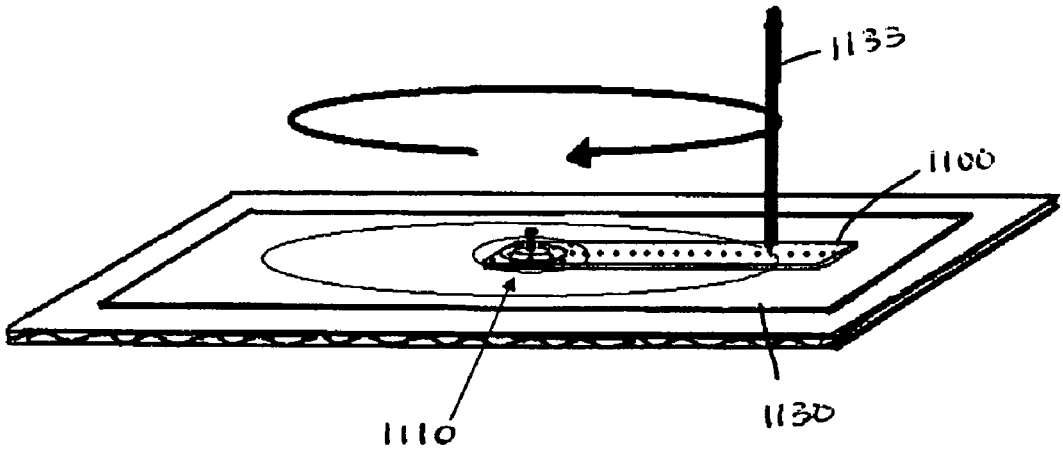

FIGS. 11 and 12 illustrate an exemplary method for using a drawing tool 1100 for drawing the circles of the framework for a Mariner's Compass star, in accordance with an embodiment of the present invention. FIG. 11 is a side perspective view of tool 1100 being used to draft an inner circle of the framework, and FIG. 12 is a side perspective view of tool 1100 being used to draft a larger, outer circle of the framework. In order to draft the framework for a Mariner's Compass star, a user needs the ability to pivot tool 1100 around a pivot point 1110. Therefore, attachment means 1107 such as, but not limited to, a pushpin or a tack, is inserted through pivot point 1110 into a drafting surface 1130 in order to accomplish this. In alternate embodiments, the tool may have attachment means incorporated into underside of the tool such as, but not limited to, a suction mechanism, a pin, embedment, adhesive, etc. The user may then insert a scribing instrument 1133 into the desired aperture in tool 1100 and move scribing instrument 1133 in a circular motion to draft the circles for the framework of the desired size of Mariner's Compass star.

In typical use of a preferred embodiment of the present invention a scribing instrument with a fine tip, such as, but not limited to, a mechanical pencil, pencil, pen, felt marker, fabric pen, metal scriber, etc., is used to mark the paper or drafting surface through all of the apertures around the pivot point of the tool, as shown by way of example in FIG. 4. The scribing instrument is then inserted into an aperture along the longitudinal line of apertures that is the desired distance from the pivot point and either the drafting surface or the tool is freely rotated in a full circle with the tip of the scribing instrument touching the drafting surface. This forms the inner circle, as shown by way of example in FIG. 11. Then, another aperture of the longitudinal line of apertures that is further from the pivot point is chosen for the outer edge of the desired pattern and is drawn in the same method as the first circle, as shown by way of example in FIG. 12. If the user is using a divided tool in which part of the longitudinal apertures are on a separate unit, as shown by way of example in FIGS. 6 and 7, the user affixes the desired flexible or rigid connection means to the two units to draft the desired larger circle. If a more complex design is desired, more circles may be drawn. The tool is then removed from the drafting surface. The user then forms the foundational rays by drawing lines over the original marks made in the first step, reaching from the edge of the outer circle to the pivot point, as shown by way of example in FIG. 5. The resulting framework of lines within at least two circles of predetermined diameters is then completed. By varying the size of the circles, a virtually infinite number of frameworks for pattern drafting may be drawn using preferred embodiments of the present invention.

Having fully described at least one embodiment of the present invention, other equivalent or alternative methods of providing drawing tools for creating frameworks for difficult to draw designs according to the present invention will be apparent to those skilled in the art. The invention has been described above by way of illustration, and the specific embodiments disclosed are not intended to limit the invention to the particular forms disclosed. For example, the particular implementation of the apertures may vary depending upon the particular type of framework being created. The frameworks described in the foregoing were directed to Mariner's Compass star implementations; however, similar techniques are to provide drawing tools with apertures configured to create frameworks for other types of designs such as, but not limited to, sunbursts, bulls eyes, flowers, etc. Implementations of the present invention that create frameworks for designs other than Mariner's Compass stars are contemplated as within the scope of the present invention. The invention is thus to cover all modifications, equivalents, and alternatives falling within the spirit and scope of the following claims.

Claim elements and steps herein have been numbered and/or lettered solely as an aid in readability and understanding. As such, the numbering and lettering in itself is not intended to and should not be taken to indicate the ordering of elements and/or steps in the claims.

What is claimed is:

1. An apparatus for drafting a framework for a pattern, the apparatus comprising:

a generally rigid planer structure;

means for enabling scribing a center point of the framework and rotating said rigid planer structure about the center point;

means for enabling scribing marks on opposite sides of the center point for forming a basis for equally spaced linear lines about the center point in the framework, where the marks are scribed with said rigid planer structure at a fixed position relative to the center point; and means for enabling scribing a circle for the framework where the circle is scribed by rotation of said rigid planer structure about the center point.

2. The apparatus as recited in claim 1, further comprising means for pivotally securing the apparatus for rotating about the center point.

3. The apparatus as recited in claim 1, further comprising means for enabling determination of dimensions of scribed lines for the framework.

4. The apparatus as recited in claim 1, further comprising means for adjustably lengthening said means for enabling scribing a circle.

5. The apparatus as recited in claim 4, further comprising means for joining said means for adjustably lengthening to the apparatus.

6. The apparatus as recited in claim 1, further comprising additional means for enabling scribing a circle for the framework.

7. An apparatus for drafting a framework for a pattern, the apparatus comprising:

a generally rigid planer structure;

a pivot point comprising a pivot point aperture extending through said rigid planer structure for enabling scribing a center point of the framework and rotating said rigid planer structure about the center point;

a plurality of marked linear lines on a top surface of said rigid planer structure and passing through said pivot point, each of said plurality of marked linear lines being equally spaced about said pivot point and comprising a plurality of apertures on both sides of said pivot point for enabling scribing marks for forming a basis for equally spaced linear lines about the center point in the framework, where the marks are scribed with said rigid planer structure at a fixed position relative to the center point; and at least one line of generally equally spaced longitudinal apertures, wherein each of said longitudinal apertures is at a first fixed radial distance from said pivot point, for enabling scribing a circle for the framework, where the circle is scribed by rotation of said rigid planer structure about said pivot point the center point.

8. The apparatus as recited in claim 7, further comprising means for pivotally securing the apparatus for rotating about said pivot point.

9. The apparatus as recited in claim 7, further comprising indicia for enabling determination of dimensions of scribed lines for the framework.

10. The apparatus as recited in claim 7, further comprising a length adjustable apparatus for adjustably lengthening said line of longitudinal apertures.

11. The apparatus as recited in claim 10, further comprising a flexible connection for joining said length adjustable apparatus to the apparatus.

12. The apparatus as recited in claim 7, further comprising an additional line of generally equally spaced additional longitudinal apertures, wherein each of said additional longitudinal apertures is at a second fixed radial distance from said pivot point, for enabling scribing a circle for the framework, where the circle is scribed by rotation of said rigid planer structure about said pivot point.

13. The apparatus as recited in claim 7, wherein said rigid structure comprises an acrylic, polymer or metal material.

14. The apparatus as recited in claim 7, wherein said rigid structure is sufficiently transparent for viewing scribed lines.

15. A method for drafting a framework for a pattern using the apparatus of claim 7, the method comprising:

steps for placing the apparatus on a desired drafting surface;

steps for scribing the center point and scribing marks on opposite sides of the center point for a basis for equally spaced linear lines about the center point in the framework, where the marks are scribed with the apparatus at a fixed position relative to the center point;

steps for choosing longitudinal apertures;

steps for scribing a plurality of circles for the framework;

steps for removing the apparatus from said drafting surface;

steps for scribing diametric lines, of an outermost circle of said plurality of circles; and steps for using the framework to scribe the pattern.

16. The method as recited in claim 15, further comprising steps for of securing the apparatus to said drafting surface.

17. The method as recited in claim 15, further comprising steps for adjustably lengthening said line of longitudinal apertures.

18. A method for drafting a framework for a pattern using the apparatus of claim 7, the method comprising the steps of:

placing the apparatus on a desired drafting surface for the apparatus to freely rotate about said pivot point;

scribing said drafting surface through said pivot point and apertures of said plurality of lines for forming the center point and scribing marks on opposite sides of the center point for a basis for equally spaced linear lines about the center point in the framework, where the marks are scribed with the apparatus at a fixed position relative to the center point;

choosing longitudinal apertures;

scribing a plurality of circles for the framework by using said chosen longitudinal apertures and rotating the apparatus relative to said drafting surface about said pivot point;

removing the apparatus from said drafting surface;

scribing diametric lines, of an outermost circle of said plurality of circles, along said scribing marks, for lines in the framework; and using the framework to scribe the pattern.

19. The method as recited in claim 18, further comprising the step of securing the apparatus to said drafting surface for rotating about said pivot point.

20. The method as recited in claim 18, further comprising the step of joining a length adjustable apparatus to the apparatus for adjustably lengthening said line of longitudinal apertures.

* * * * *